US005374782A

United States Patent [19]

Taylor et al.

[11] Patent Number: 5,374,782

[45] Date of Patent: Dec. 20, 1994

[54] STRANDED ANNULAR CONDUCTORS

[76] Inventors: John A. Taylor, 4174 S. Mission Rd., Fallbrook, Calif. 92028; Robert C. Bartlett, 385 Ridge Ave., Winnetka, Ill. 60093

[21] Appl. No.: 84,461

[22] Filed: Jul. 1, 1993

[51] Int. Cl.[5] ..... H01B 7/34; H01B 7/22

[52] U.S. Cl. ..... 174/130; 174/102 R; 174/113 C; 174/131 A

[58] Field of Search ..... 174/130, 113 C, 131 A, 174/131 B, 102 R, 109, 131 R

[56] References Cited

U.S. PATENT DOCUMENTS

| | | | |
|---|---|---|---|
| 2,342,736 | 2/1944 | Herzog et al. | 174/108 |
| 2,453,418 | 11/1948 | Dunsheath et al. | 174/101.5 |
| 3,636,234 | 1/1972 | Wakefield | 174/36 |
| 3,678,177 | 7/1972 | Lawrenson | 174/113 C |
| 3,823,253 | 7/1974 | Walters et al. | 174/113 C |
| 4,039,743 | 8/1977 | Gommans | 174/114 R |
| 4,546,210 | 10/1985 | Akiba et al. | 174/114 R |
| 4,549,042 | 10/1985 | Akiba et al. | 174/114 R |
| 4,997,992 | 5/1991 | Low | 174/113 C |

FOREIGN PATENT DOCUMENTS

| | | | |
|---|---|---|---|
| 448670 | 5/1948 | Canada | 174/113 C |
| 809868 | 5/1959 | United Kingdom | 174/113 C |

*Primary Examiner*—Morris H. Nimmo

*Attorney, Agent, or Firm*—Ross, Ross & Flavin

[57] ABSTRACT

An annular conductor consists of a central core (dielectric), circumscribed by a tubular helically wound braid of sets of pairs of strands (insulated or uninsulated), with an electrically insulating protective covering around the braid, and an outermost aluminum foil wrapping circumscribing the protective covering.

4 Claims, 1 Drawing Sheet

STRANDED ANNULAR CONDUCTORS

Our invention relates to annular conductors for the transmission of audio, video or data signals.

The transmission of audio, video and data signals, with their complex wave forms, is influenced by a plurality of considerations including:

1) type of dielectric insulation material,
2) wall thickness of the insulation material,
3) size and/or combination of sizes of the individual wire strands,
4) cross sectional geometry of the wire bundles,
5) number of twists per foot,
6) angle of the wound wire relative to the center line,
7) type of wire,
8) purity of the wire,
9) crystaline structure of the wire,
10) number of twists per foot in the wire bundle,
11) relationship of the + or − (send and return) conductors to each other, i.e. the distance between each other and whether oriented in parallel with, or twisted around each other,
12) whether or not the wire strands are insulated from each other,
13) effects of inductance based on design and construction,
14) effects of capacitance based on design and construction,
15) resistivity,
16) type of cable assembly materials and construction techniques,
17) effects of phase shifts based on design and construction,
18) effects of acoustic and mechanical resonances based on design and construction,
19) effects of EMI, RFI, hum, and magnetic strand interaction, and electrical strand interaction,
20) protection against aging (the corrosive effects of atmosphere), and
21) skin effect.

The invention comprehends a foil-wrapped, insulated, stranded annular conductor which offers a new and innovative approach to the transmission of low voltage audio signals, particularly for frequencies above 250 Hertz, as well as for the optimum transmission of complex wave forms within and above the audio frequency range, all with the lowest possible distortion.

The invention envisions any combination of insulated stranded wire diameters or any combination of uninsulated stranded wire diameters.

Uniform current density is comprehended due to the employment of a thin braided or spirally wound conductor which is no more than two wire diameters in thickness at any point.

DESCRIPTION OF THE PREFERRED EMBODIMENT

Figure 1:
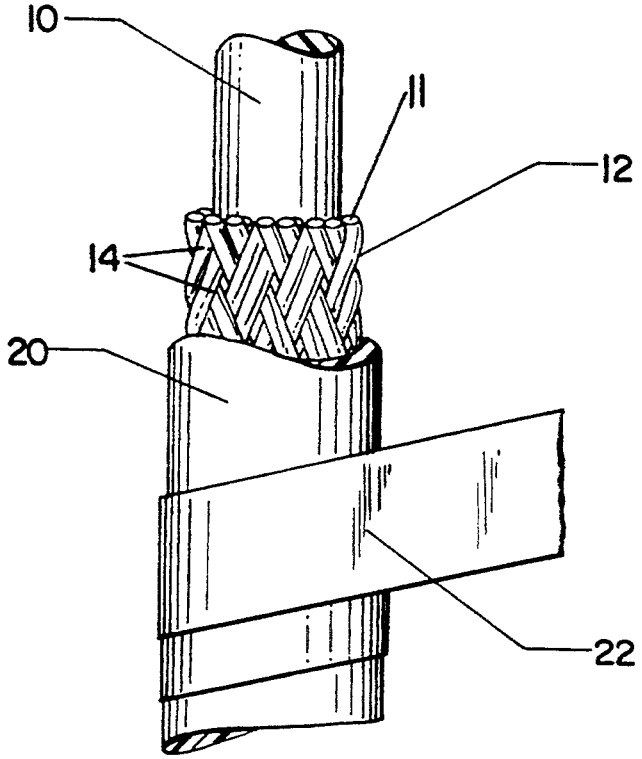
FIG. 1 is a fragmentary broken-away view in side elevation of an insulated, stranded, annular conductor of the invention.
Figure 2:
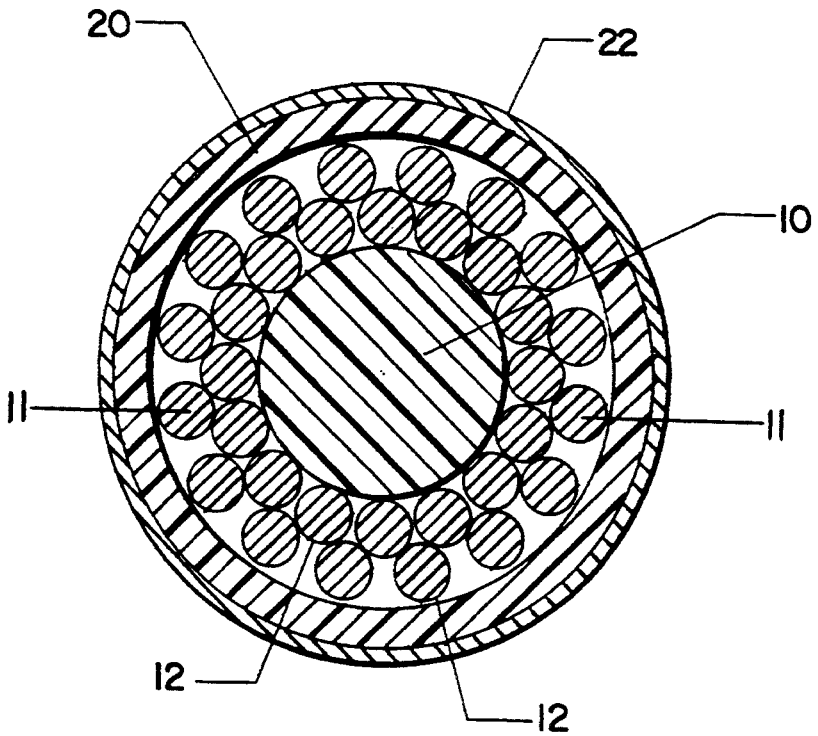
FIG. 2 is a transverse sectional view through the FIG. 1 conductor.

An annular conductor, according to the invention, is shown in FIGS. 1 and 2, and comprises a solid rod-shaped central or inner precision sized core 10 of a flexible, dielectric material such as a fluoropolymer resin or "Teflon", intended to maintain the wires sleeved therearound in a desired tubular configuration,-which core, optionally, can be of solid configuration, or of a hollow tube form.

The wire strands 11 are comprised of #33 AWG wire, we having found same to offer the best balance of skin effect and signal strength.

Advantageously, the small diameter of each strand should be the same.

Each strand is preferentially provided with its own electrically insulating covering 12 although significant results are achievable without the insulation. The covering may be of polyurethane resin or equivalent.

As shown, 32 strands are woven into a tubular braid incorporating two opposed helically arranged sets of pairs by means of a braiding machine.

A close consideration of FIG. 1 will show the one set of a pair of wire strands is interlaid in such manner that each strand of the set repeatedly passes over a pair of strands of a consecutive set and then under the next pair of strands of the next consecutive set.

That is, the strands are braided in pairs around the core, the braiding allowing the exceptionally tight wrap of the strands around the fluropolymer resin core so as to minimize acoustical and mechanical resonances.

By the pairing of the strands in sets, the interlacing allows the passing of one set over the strands of the next consecutive set and then under the strands of the next consecutive set to the desirable end that the conductor is never more than two wire diameters in thickness at any point or region. By this system, a more uniform current density is achieved.

Alternatively, the strands of wire could be spirally wound all in one direction around the core instead of being braided, as above described, the strands themselves being insulated or uninsulated, as preferred.

As an even further alternate form, the first layer of wires insulated or uninsulated, could be spirally wound in a clockwise direction with the second layer being spirally wound in a counterclockwise direction.

The configuration of only two layers of strands offers the advantage that magnetic strand interaction is minimized.

Lay cancelling is attained so as to help to reduce reactance and to provide greater stability and lessen interference effects.

The outer exterior Of the braid is covered with a fluoropolymer resin dielectric material 20 as in the case of the core, resulting advantageously in a uniform dielectric material on both sides of the annular conductor.

The selection of a precision sized core of the same dielectric material as the outer jacket allows the attainment of the overall American Wire Gauge.

Outboard of the insulation 20, and sheathed thereover is a shielding of an aluminum foil wrap 22, with an overlap of at least 55% so as to minimize RFI and hum.

Such an annular conductor as described has the equivalency of approximately #18 AWG.

The annular conductor of this design minimizes phase shift as caused by back emf particularly when used in conjunction with audio speaker cables.

It is to be stressed that the conductor hereof is not of a coaxial design, it being limited to conducting only one leg of the signal. Advantageously, with the single leg type of conductor, the problems inherent in the coaxial configuration are avoided. Overall wire gauge and other electrical characteristics cannot be the same between both legs of a coaxial design.

It is to be appreciated that the annular conductor hereof maximizes the conductive properties of the wire strands as contrasted to a solid core or stranded bundles of wires and minimizes the usual waste in conductive materials of heretofore known designs.

The design permits the use of exotic materials as the wire strands as opposed to having to extrude such exotic materials with a hollow core.

It is to be mentioned in passing, that the letter and spirit of this invention is equally valid with other types of dielectric materials such as high molecular weight fluoropolymer resin, polyurethane, polypropylene, polythylene, and equivalents.

The invention incorporating the design features previously delineated can be exploited with any combination of insulated or non-insulated wire diameters.

We claim:

1. An annular conductor comprising:

a central dielectric core, a tubular braid circumscribing the core and having two opposed helically running sets of pairs of strands of individually insulated wires, the two sets of pairs of strands of wires being so interlaced that the strands of each set of pairs repeatedly pass over the strands of the next consecutive set of pairs and then under the strands of the next following consecutive set of pairs, a protective covering of electrically insulating, relatively flexible material fitted over the tubular braid, and a wrapping of an aluminum foil around the covering of insulating material.

2. An annular conductor comprising:

a central dielectric core, a tubular braid circumscribing the core and having two opposed helically running sets of pairs of strands of individual wires, the two sets of pairs of strands of wires being so interlaced that the strands of each set of pairs repeatedly pass over the strands of the next consecutive set of pairs and then under the strands of the next following consecutive set of pairs, a protective covering of electrical insulating, relatively flexible material fitted over the tubular braid, and a wrapping of an aluminum foil around the covering of insulating material.

3. An annular conductor comprising:

a central dielectric core, a tubular braid circumscribing the core and having two opposed helically running sets of pairs of strands of individually insulated #33 AWG wires, the two sets of pairs of strands of wires being so interlaced that the strands of each set of pairs repeatedly pass over the strands of the next consecutive set of pairs and then under the strands of the next following consecutive set of pairs, a protective covering of electrically insulating, relatively flexible material fitted over the tubular braid, and a wrapping of an aluminum foil around the covering of insulating material.

4. An annular conductor comprising:

a central dielectric core, a tubular braid circumscribing the core and having two opposed helically running sets of pairs of strands of #33 AWG wires, the two sets of pairs of strands of wires being so interlaced that the strands of each set of pairs repeatedly pass over the strands of the next consecutive set of pairs and then under the strands of the next following consecutive set of pairs, a protective covering of electrically insulating, relatively flexible material fitted over the tubular braid, and a wrapping of an aluminum foil around the covering of insulating material.

* * * * *